United States Patent [19]

Heller et al.

[11] Patent Number: 4,632,153

[45] Date of Patent: Dec. 30, 1986

[54] PICKING BAND WHEEL FOR A WEAVING MACHINE

[75] Inventors: Rudolf Heller, Zurich; Heiner Kern, Seuzach, both of Switzerland

[73] Assignee: Sulzer Brothers Limited, Winterthur, Switzerland

[21] Appl. No.: 828,313

[22] Filed: Feb. 11, 1986

[30] Foreign Application Priority Data

Feb. 11, 1985 [CH] Switzerland ..... 601/85

[51] Int. Cl.[4] ..... D03D 47/12

[52] U.S. Cl. ..... 139/449; 74/449; 474/152

[58] Field of Search ..... 139/449, 446, 443; 474/152, 161, 164, 197, 180; 74/449

[56] References Cited

U.S. PATENT DOCUMENTS 3,987,822 10/1976 Freisler ..... 139/449
4,131,032 12/1978 Warland et al. ..... 474/152
4,231,265 11/1980 Hanisch et al. ..... 474/152
4,252,156 2/1981 Brown et al. ..... 139/449
4,547,179 10/1985 Ohhashi ..... 474/152
4,555,240 11/1985 Hayashi ..... 74/449

FOREIGN PATENT DOCUMENTS 0629859 5/1982 Switzerland ..... 139/449

*Primary Examiner*—Henry S. Jaudon
*Attorney, Agent, or Firm*—Kenyon & Kenyon

[57] ABSTRACT

The picking band wheel is made of a hub and two wheel discs. Each disc is provided with pocket-like spoke parts which have transverse walls at the bottom which abut the transverse walls of the other disc on a common connecting plane disposed substantially perpendicularly to the axis of rotation of the wheel. The front disc has a conical end wall in which the pocket-like spoke parts are formed so that an alternating spoke pattern is formed. The back disc has a flat end wall.

16 Claims, 5 Drawing Figures

PICKING BAND WHEEL FOR A WEAVING MACHINE

This invention relates to a wheel. More particularly, this invention relates to a picking band wheel for a weaving machine.

As is known, weaving machines have been provided with picking band wheels for the picking of a weft yarn. For example, Swiss Pat. No. 629,859 describes an oscillating picking band wheel which is formed of a hub and a body which is comprised of a number of cells disposed in a honeycomb structure parallel to the wheel axis and which is closed on both sides by a circular plate and operatively connected to the wheel hub. However, a wheel of this type is not sufficiently rigid for modern high performance weaving machines.

Accordingly, it is an object of the invention to provide a picking band wheel for a high performance weaving machine.

It is another object of the invention to provide a picking band wheel of relatively rigid construction.

It is another object of the invention to provide a wheel of minimal weight and of compact construction.

It is another object of the invention to provide a picking wheel which is able to occupy a minimum of space in a weaving machine.

Briefly, the invention provides a wheel which is comprised of a hub and a pair of wheel discs which are mounted on the hub. In addition, each wheel disc has an annular rim engaging an annular rim of the other disc and a main wall having a plurality of inwardly extending and circumferentially spaced pocket-like spoke parts. In addition, each spoke part includes a tranverse wall at a base thereof which abuts a transverse wall of a respective spoke part of the other wheel disc.

The configuration of each wheel disc is such that an alternating pattern of spoke parts is formed. That is, the pocket-like spoke parts are separated by spoke parts which are formed, in part, by the segments of the main wall of each wheel disc.

The wheel discs are mounted at opposite ends of the hub with the transverse walls of the respective pocket-like spoke parts in abutment along a radial plane which passes through the hub.

The alternating arrangement of the spoke parts and the transverse walls of the pocket-like spoke parts give the wheel considerable ability to withstand transverse stressing. Thus, the wheel is able to run uniformly and very stably despite being subjected to transverse forces.

The wheel may be made of various materials to obtain a strong but light-weight structure. For example, the wheel discs may be made of glass fiber reinforced plastic. This permits a reduction in the specific weight (density) and, therefore, provides a reduced moment of mass inertia.

These and other objects and advantages of the invention will become more apparent from the following detailed description taken in conjunction with the accompanying drawings wherein.

Figure 1:
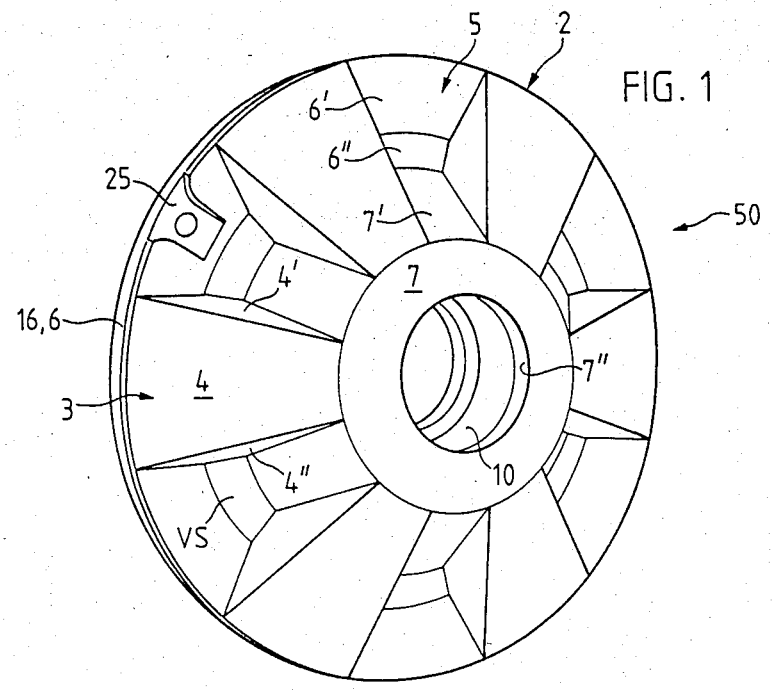
FIG. 1 illustrates a perspective front view of a picking band wheel constructed in accordance with the invention.

Referring to FIG. 1, the picking band wheel 50 is constructed so as to be driven around a rotational axis (not shown) for picking purposes in a weaving machine.

Figure 4:
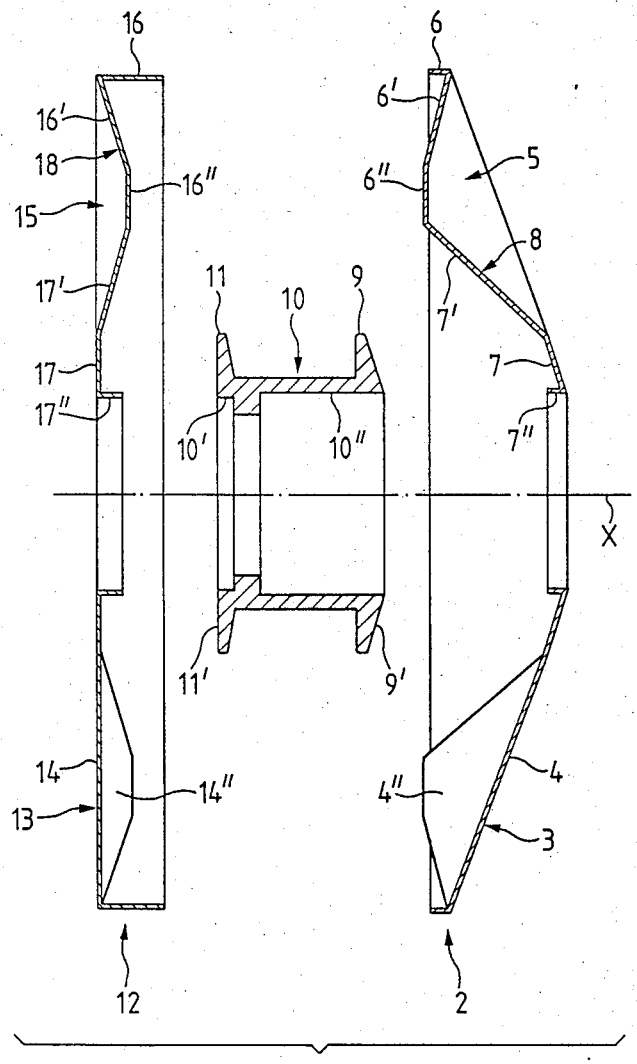
FIG. 4 illustrates an exploded view of the wheel taken along line A—A of FIG. 3.
Figure 5:
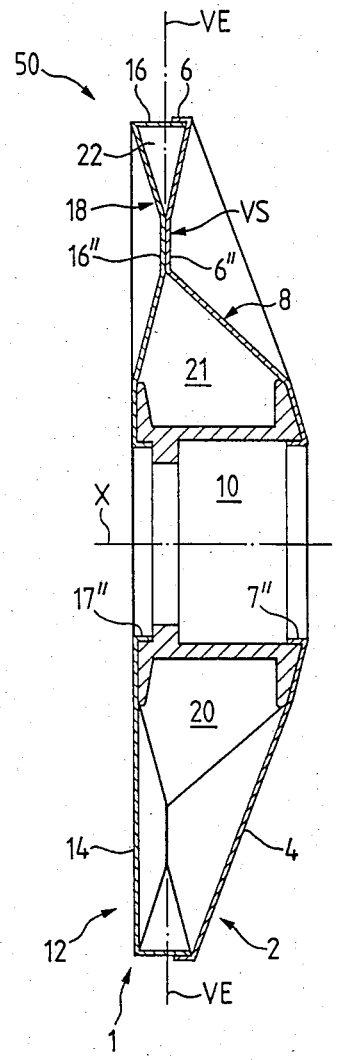
FIG. 5 illustrates a cross sectional view of the wheel taken on line A—A of FIG. 3.

Referring to FIGS. 4 and 5, the wheel 50 is constructed of a hub 10 and a pair of wheel discs 2, 12 which are mounted on the hub 10. The hub 10 is made of metal, preferably a light metal, while the discs 2, 12 are made of an appropriate plastic, for example, a glass fiber reinforced plastic. For example, the discs 2, 12 may be formed by a pressure or vacuum or deep drawing process or the like.

The hub 10 includes a flange 9 with a conical engagement or bearing surface 9′ at one end and a second flange 11 with a bearing surface 11′ disposed perpendicularly to an axis of rotation X. In addition, the hub 10 defines a pair of bores 10′, 10″.

Referring to FIGS. 1, 4 and 5, the disk 2 includes an annular outer rim 6, an inner annular collar 7 and two sets of spoke parts 3, 5 which are circumferentially spaced about the disk 2 and which interconnect the rim 6 and collar 7. As indicated in FIGS. 4 and 5, the inner collar 7 carries a peripheral rim 7″ which is secured to the hub 10, for example by an adhesive.

The disc 2 is formed with a main wall 4 in which a plurality of inwardly extending and circumferentially spaced pocket-like spoke parts 5 are provided. As indicated in FIGS. 1 and 4, each pocket-like spoke part includes a transverse wall 6″ at a base thereof and a pair of conical parts 6′, 7′ which extend from opposite radially disposed ends of the transverse wall 6″. The transverse end wall 6″ and adjacent conical parts 6′, 7′ are formed by a continuous wall portion 8 which is offset from the plane of the end wall 4. As shown in FIG. 1, each pocket-like spoke part 5 also has a pair of side walls 4′, 4″ which extend from the transverse wall 6″ to the plane of the end wall 4.

The end wall 4 of the disc 2 and the side walls 4′, 4″ serve to form alternating spoke parts 3 with the pocket-like spoke parts 5. In addition, the spoke parts 3 are of pocket-like construction on the inside of the disc 2.

Referring to FIGS. 1 and 5, the end wall 4 is of conical shape relative to the axis of rotation X.

Figure 3:
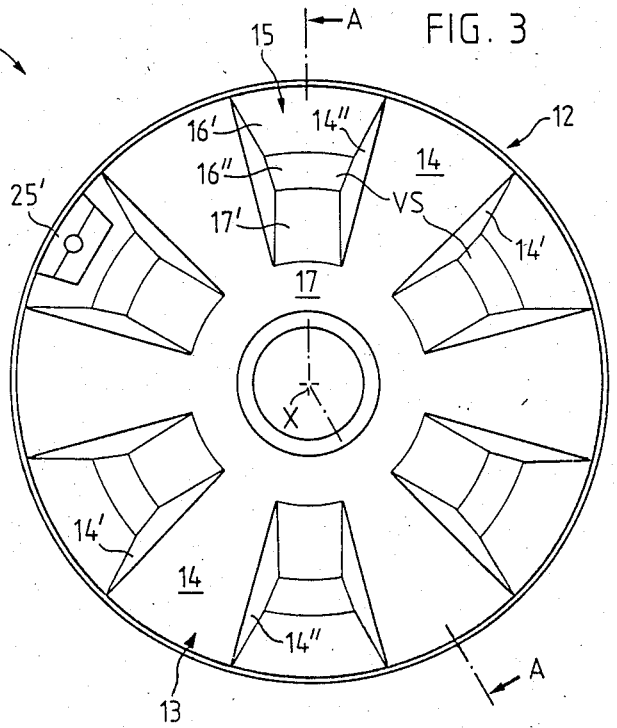
FIG. 3 illustrates a back view of the wheel of FIG. 1.

Referring to FIGS. 3, 4 and 5, the second disc 12 has an outer annular rim 16 in the form of a collar, an inner collar 17″ and an end wall 14 between the rim 16 and collar 17″. The end wall 14 is a flat planar wall, i.e. the wall 14 is disposed perpendicular to the axis of rotation X. In addition, a plurality of inwardly extending and circumferentially spaced pocket-like spoke parts 15 are disposed in the wall 14. Each spoke part 15 includes a transverse wall 16″ at a base thereof and a pair of conical parts 16′, 17′ which extend from the radial inner and outer ends of the wall 16″. As indicated in FIG. 4, the transverse wall 16″ and conical parts 16′, 17′ are formed by a continuous wall 18. In addition, each spoke part 15 has a pair of side walls 14′, 14″ which extend from the transverse wall 16″ to the end or main wall 14.

Referring to FIGS. 4 and 5, the inner collar 17″ of the disc 12 is received in and adhesively secured to the aperture 10′ of the hub 10 while the transverse wall 16″ is in abutting relation with a respective transverse wall 6″ of the first disc 2. As indicated in FIG. 5, the abutting transverse walls 6″, 16″ abut along a common plane VE which passes perpendicularly through the axis of rotation X as well as through the hub 10. Alternatively, the abutting transverse walls 6", 16" may be inclined at an angle to the plane VE.

Referring to FIG. 1, the disc 2 may be provided with a force-introducing securing part 25 for a picking belt or band (not shown). As indicated, this part 25 may be disposed on the outer rim 6 within the plane of a pocket-like spoke part 5. In like manner, as indicated in FIG. 3, the disk 12 may be provided with a force-introducing securing part 25' in the plane of a pocket-like spoke part 15 as a counterpart to the part 25 on the disc 2.

Figure 2:
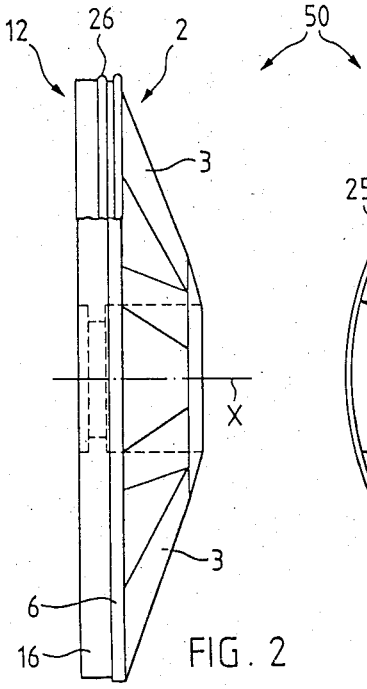
FIG. 2 illustrates a side view of the wheel of FIG. 1.

Referring to FIG. 2, the disc 2 may form the front of the wheel while the disc 12 forms the back of the wheel. In this case, the spoke parts 3 of the disc 2 are disposed at an inclination to the disc 12. In addition, a running profile 26 for a picking belt is disposed on the outer periphery of the engaged discs 2, 12 and is secured by a suitable means (not shown).

As shown in FIG. 5, the discs 2, 12 are interconnected with each other by way of the outer rim 6, 16 and in the connecting plane VE by way of the segmented flat transverse walls 6", 16" which are distributed around the periphery and each of which forms a junction VS. Further, the front disc 2 is connected by way of the inner collar 7" to the hub 10 while the back disc 12 is connected by way of the inner collar 17" to the hub 10. The two discs 2, 12 define an annular chamber 20 which is sub-divided near the pocket-like spoke parts 5, 15 by the peripherally distributed junctions VS into an inner annular chamber 21 and an outer annular chamber 22. The various contacting surfaces of the discs 2, 12 and hub 10 may be secured together, for example by an adhesive.

As indicated in FIG. 5, the interconnection of the wall parts 8, 18 via the transverse walls 6", 16" serve to rigidly connect the discs 2, 12 together while forming a substantially transverse wall structure in the connecting plane VE. Thus, the rigidity of the wheel 50 is enhanced. The preferred conical and, as referred to the connecting plane VE, asymmetrical shaping of the front disc 2 provides a further improvement in the rigidity of the wheel.

By making the back of the wheel 50 flat and perpendicular to the axis of rotation X, little space is required in a weaving machine (not shown). However, the wheel may also be constructed of two disks which are constructed in symmetrical relation relative to the connecting plane VE, i.e. the wheel body may be formed of either two discs 2 or two discs 12 which are connected at the junctions VS.

The invention thus provides a wheel with spoke parts which are distributed uniformly around the periphery and which has a substantial transverse wall structure of relatively substantial rigidity.

Further, the invention provides a wheel which is virtually uneffected by transverse forces. Thus, the use of the wheel is not limited to a picking belt wheel for a weaving machine.

The invention further provides a wheel which is able to be subjected to relatively high transverse loads.

What is claimed is:

1. A picking band wheel for a weaving machine comprising a hub;

a first wheel disc mounted on said hub, said disc including a main wall having a plurality of inwardly extending and circumferentially spaced pocket-like spoke parts therein, each said spoke part including a transverse wall at a base thereof; and a second wheel disc mounted on said hub to form a band receiving body with said first wheel disc, said second wheel disc including a main wall having a plurality of inwardly extending and circumferentially spaced pocket-like spoke parts therein, each said spoke part of said second disc including a transverse wall at a base thereof disposed in abutting relation with a respective transverse wall of a spoke part of said first disc.

2. A picking band wheel as set forth in claim 1 wherein said discs are symmetrically disposed about a common transverse plane.

3. A picking band wheel as set forth in claim 1 wherein said discs are asymmetrically disposed about a common transverse plane.

4. A picking band wheel as set forth in claim 1 wherein each transverse wall of a respective disc is inclined to a common transverse plane passing through said discs.

5. A picking band wheel as set forth in claim 1 wherein said main wall of at least one of said discs is of conical shape.

6. A picking band wheel as set forth in claim 1 wherein said main wall of at least one of said discs is a flat planar wall.

7. A picking band wheel as set forth in claim 1 wherein each spoke part of at least one of said discs/includes a pair of conical parts extending from opposite radially disposed ends of said transverse wall thereof.

8. A picking band wheel as set forth in claim 1 wherein each wheel disc includes an annular rim disposed in engagement with an annular rim of the other wheel disc.

9. A picking band wheel as set forth in claim 1 wherein said spoke parts of each respective wheel disc are distributed uniformly about the circumference of each respective disc.

10. A picking band wheel as set forth in claim 1 which further comprises a force-introducing part secured to at least one of said wheel discs.

11. A picking band wheel as set forth in claim 1 wherein each said disc is made of glass fiber reinforced plastic and is adhered to said hub.

12. A picking band wheel as set forth in claim 1 wherein each disc includes an annular collar radially inwardly of said main wall and a peripheral rim on said collar secured to said hub.

13. A wheel comprising a hub; and a pair of wheel discs mounted on said hub, each said disc having an annular rim engaging an annular rim of the other disc and a main wall having a plurality of inwardly extending and circumferentially spaced pocket-like spoke parts therein, each said spoke part including a transverse wall at a base thereof abutting a transverse wall of a respective spoke part of the other disc.

14. A wheel as set forth in claim 13 wherein said hub is made of metal and each disc is made of fiber glass reinforced plastic.

15. A wheel as set forth in claim 13 wherein said main wall of at least one of said discs is of conical shape.

16. A wheel as set forth in claim 13 wherein said main wall of at least one of said discs is a flat planar wall.

* * * * *